US011492842B2

(12) United States Patent
Neander et al.

(10) Patent No.: US 11,492,842 B2
(45) Date of Patent: Nov. 8, 2022

(54) INSULATING GLAZING AND WINDOW

(71) Applicant: SAINT-GOBAIN GLASS FRANCE, Courbevoie (FR)

(72) Inventors: Marcus Neander, Eschweiler (DE); Hans-Werner Kuster, Aachen (DE); Guenael Morvan, Marseilles (FR); Nicholas Koren, Faribault, MN (US); Ariane Weissler, Aachen (DE); Christopher Marjan, Aachen (DE)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 230 days.

(21) Appl. No.: 16/964,086

(22) PCT Filed: Jan. 8, 2019

(86) PCT No.: PCT/EP2019/050273
§ 371 (c)(1),
(2) Date: Jul. 22, 2020

(87) PCT Pub. No.: WO2019/141532
PCT Pub. Date: Jul. 25, 2019

(65) Prior Publication Data

US 2021/0032925 A1 Feb. 4, 2021

Related U.S. Application Data

(60) Provisional application No. 62/620,085, filed on Jan. 22, 2018.

(30) Foreign Application Priority Data

Feb. 22, 2018 (EP) ..... 18158001

(51) Int. Cl.
*E06B 3/663* (2006.01)
*E06B 3/667* (2006.01)
*E06B 3/673* (2006.01)

(52) U.S. Cl.
CPC ..... *E06B 3/66366* (2013.01); *E06B 3/667* (2013.01); *E06B 3/66342* (2013.01); *E06B 3/67326* (2013.01); *E06B 2003/6638* (2013.01)

(58) Field of Classification Search
CPC ..... E06B 2003/66395; E06B 3/663; E06B 3/667; E06B 3/66304; E06B 3/66309;
(Continued)

(56) References Cited

U.S. PATENT DOCUMENTS 4,691,486 A 9/1987 Niekrasz
6,115,989 A * 9/2000 Boone ..... E06B 3/66366 52/786.13

(Continued)

FOREIGN PATENT DOCUMENTS

CN 103608542 A 2/2014
CN 105308252 A 2/2016

(Continued)

OTHER PUBLICATIONS

International Search Report as issued in International Patent Application No. PCT/EP2019/050273, dated Apr. 9, 2019.

*Primary Examiner* — Kyle J. Walraed-Sullivan
(74) *Attorney, Agent, or Firm* — Pillsbury Winthrop Shaw Pittman LLP

(57) ABSTRACT

An insulating glazing includes at least one first pane element, at least one spacer, and at least one connector. The spacer and the connector are arranged next to each other such that they extend along a common longitudinal axis, wherein the spacer and the connector accommodate and position the first pane element. The connector has at least (Continued)

Figure 1:
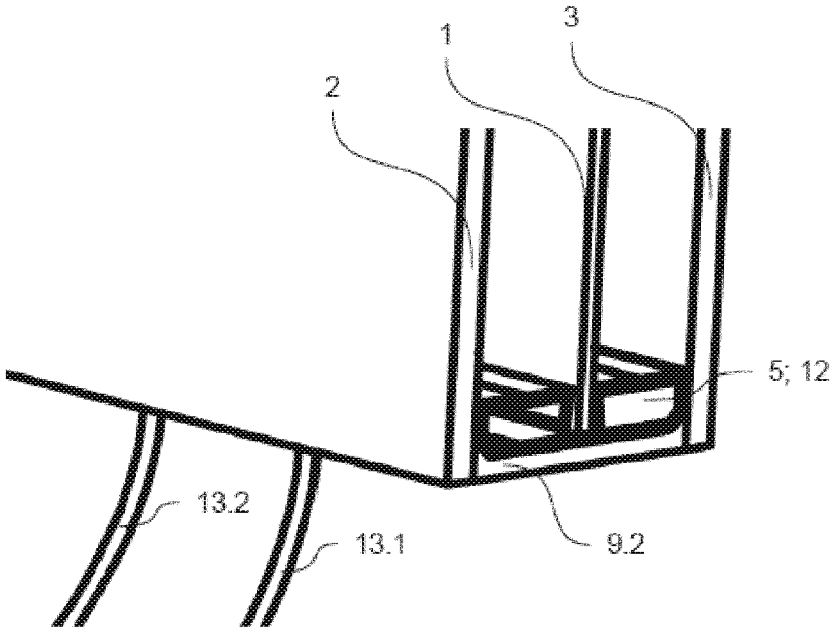

one first electrically conductive conductor element such that an electrical connection can be established between an external power source and the first pane element via the first conductor element.

8 Claims, 3 Drawing Sheets

(58) Field of Classification Search
CPC ..... E06B 3/66314; E06B 3/66319; E06B 3/66342; E06B 3/66347; E06B 3/66352; E06B 3/66366; E06B 3/66376; E06B 3/6675; E06B 3/67326
USPC ..... 52/786.13
See application file for complete search history.

(56) References Cited

U.S. PATENT DOCUMENTS

| | | | | |
|---|---|---|---|---|
| 2008/0135543 | A1* | 6/2008 | Johnson | H05B 3/84 219/522 |
| 2012/0026573 | A1 | 2/2012 | Collins et al. | |
| 2012/0141699 | A1* | 6/2012 | Mader | E06B 3/66366 428/34 |
| 2013/0319756 | A1 | 12/2013 | Snyker et al. | |
| 2014/0130428 | A1* | 5/2014 | Dreux | E06B 3/677 52/171.3 |
| 2016/0138326 | A1* | 5/2016 | Kuster | E06B 3/67 52/204.595 |
| 2017/0321472 | A1* | 11/2017 | Frank | E06B 3/67326 |
| 2017/0328119 | A1* | 11/2017 | Kuster | E06B 3/66 |
| 2018/0038150 | A1* | 2/2018 | Kuster | E06B 3/66347 |
| 2019/0383087 | A1* | 12/2019 | Hermens | E06B 3/667 |
| 2020/0300029 | A1* | 9/2020 | Hervieux | E06B 3/66366 |
| 2020/0324451 | A1* | 10/2020 | Kuster | E06B 3/66319 |
| 2020/0408033 | A1* | 12/2020 | Haring | G02B 6/0091 |
| 2021/0159354 | A1* | 5/2021 | Sala | E06B 3/66376 |

FOREIGN PATENT DOCUMENTS

| | | | | |
|---|---|---|---|---|
| EP | 0 876 608 | B1 | 4/2002 | |
| EP | 3477035 | A1 * | 5/2019 | E06B 3/66314 |
| JP | 2017-105664 | A | 6/2017 | |
| WO | WO 00/58580 | A1 | 10/2000 | |
| WO | WO 2011/033313 | A1 | 3/2011 | |
| WO | WO 2012/007334 | A1 | 1/2012 | |
| WO | WO 2013/038409 | A2 | 3/2013 | |
| WO | WO 2017/106458 | A1 | 6/2017 | |

* cited by examiner

INSULATING GLAZING AND WINDOW

CROSS-REFERENCE TO RELATED APPLICATIONS

This application is the U.S. National Stage of PCT/EP2019/050273, filed Jan. 8, 2019, which in turn claims priority to U.S. provisional patent application No. 62/620,085 filed Jan. 22, 2018 and European patent application number 18 158 001.0 filed Feb. 22, 2018. The content of these applications are incorporated herein by reference in their entireties.

The invention relates to an insulating glazing, in particular a triple glazing or a multiple glazing, and a window with such insulating glazing.

Insulating glazings usually comprise at least two pane elements and a circumferential spacer frame arranged between these pane elements. The pane elements are connected to the spacer frame via seals such that a tightly sealed interpane space is created. This interpane space is so tight that, ideally, no moisture can penetrate, and if there is a gas filling, ideally, no gas filling can escape.

So-called active glazings or functional glazings offer the possibility of realizing illuminated glazings, glazings with electrical sun screens or blinds, or switchable glazings, including glazings with zones differently or separately switchable, or the like. In the case of an active glazing or functional glazing in the form of an insulating glazing, functional coatings or units can be arranged in the interpane space such that they are protected against moisture and corrosion thanks to the sealing of the inner interpane space.

Usually, a large number of current-carrying conductors are required to be able to provide a suitable power supply for such glazings. These current conductors are routed through the seals of the insulating glazings or windows.

The preparation and arrangement of the current conductors is done manually and thus requires time-consuming and cost-intensive production of the insulating glazings or windows. Since the numerous current conductors must be routed through the seals, numerous possible defect points for liquid and gas leaks are also created.

Active glazings contain a functional element, which typically contains an active layer between two surface electrodes. The optical properties of the active layer can be changed by voltage applied to the surface electrodes. Electrochromic elements, known, for example, from 20120026573 A1 and WO 2012007334 A1 are an example of this. SPD elements (suspended particle device), known, for example, from EP 0876608 B1 and WO 2011033313 A1 are another example. The transmittance of visible light through electrochromic or SPD elements can be controlled by the voltage applied. The voltage is applied via so-called busbars that are usually applied on the surface electrodes and are connected to a voltage source via suitable connecting cables.

In an insulating glazing with active glazing, the voltage feed must be designed gas- and water-tight in order to ensure sufficient quality and service life of the insulating glazing. In WO 2017/106458 A1, the electrical feed line itself is designed in shape and size such that it has higher tolerance against relative movements in the event of different thermal expansion of the components involved. However, the feed line itself is made between the spacer and the adjacent pane through the primary sealant used for bonding and sealing. Such cable routing through the edge seal of the insulating glazing also always constitutes a potential defect point.

The object of the invention is thus to provide an insulating glazing that enables simple and economical assembly of the glazing and can provide improved tightness. A further object of the invention is to provide a suitable window.

The object of the present invention is accomplished according to the invention by an insulating glazing and a window according to the independent claims 1 and 12. Advantageous embodiments and further developments emerge from the dependent claims and from the description with reference to the figures.

The insulating glazing according to the invention, in particular a triple glazing or a multiple glazing, is provided with at least one first pane element, at least one spacer, and at least one connector, with the spacer and the connector arranged next to each other such that they extend along a common longitudinal axis. The spacer and the connector are intended to accommodate and position the first pane element. The connector has at least one first electrically conductive conductor element such that an electrical connection can be established between an external power source and the first pane element via the first conductor element.

The invention is based on the idea of specifically supplying a functional glazing or active glazing with electrical energy. By means of at least one connector, the introduction of electrical energy can be provided at specific points of the insulating glazing all the way to the functional pane.

In particular, a uniform power supply is intended to be achieved along the entire surface of the functional pane element by means of the connectors. Thus, provision is made not only to reduce the effort required for producing the insulating glazing or a window with insulating glazing or active glazing, but also to optimize the tightness of the insulating glazing.

In this context, the insulating glazing according to the invention is provided with at least one first pane element, at least one spacer, and at least one connector, with the spacer and the connector arranged next to each other such that they extend along a common longitudinal axis. The spacer and the connector are intended to accommodate and to position the first pane element.

Preferably, the insulating glazing includes a first sealing component for bonding the outer pane elements to the spacer and the connector. The first sealing component ensures the sealing of the interpane space between the outer pane elements. In addition, the insulating glazing preferably includes a second sealing component, which is arranged on the side of the spacer and the connector facing outward in the direction of the window frame. The outer pane elements are the pane elements that delimit the interpane space relative to the external environment.

The first pane element is designed in particular as an electrically active or activatable pane element of the insulating glazing or of the window. For example, the first pane element can be an electrochromic pane element, a liquid crystal pane element, a display in the form of a TFT or LCD screen, a pane element with an electrically conductive coating for achieving a heating effect, or the like, in order to provide an electrically active or activatable pane element.

The spacer can be designed in particular as a commercially available spacer for insulating glazings. Thus, the at least one first pane element is arranged on or in the spacer.

Furthermore, the spacer can comprise a material such as stainless steel, aluminum, plastic, or a comparable material or a comparable combination of materials. In this context, the at least one spacer of the insulating glazing according to the invention can be designed as a commercially available spacer.

The insulating glazing according to the invention is intended to be used with a suitable window frame.

Such a window frame is preferably provided such that it suitably surrounds the insulating glazing with the at least one first pane element.

In particular, the insulating glazing or the window frame can be used with an insulating glazing according to the invention for a window.

Preferably, the at least one spacer is provided along an edge region or a side edge of the first pane element. A plurality of spacers can be provided along one side edge of an insulating glazing. Provision is also made for one or a plurality of spacers to be arranged along all side edges of the insulating glazing.

A spacer and a connector are arranged next to each other along a common longitudinal axis, i.e., are provided one after another in the longitudinal direction. In this context, the cross-sectional surfaces of the spacer and of the connector are joined to one another.

Provision is preferably made for a connector to be placed between two spacers along a side edge of a pane element.

Alternatively, a connector can be directly connected to a so-called corner element or corner connector in the context of the present invention. Preferably, such corner connectors are also to be considered as a development of a spacer.

In particular, provision can be made along a side edge of a first pane element for any plurality of connectors and a corresponding plurality of spacers to be arranged alternatingly next to each other.

The spacers and the connectors are designed such that the first pane element can be accommodated and positioned.

If additional pane elements, in particular a second and a third pane element are provided, the individual pane elements of the insulating glazing are appropriately positioned relative to one another by means of the at least one spacer and the at least one connector.

In the context of a window with insulating glazing or triple/multiple glazing or active glazing, provision is made for spacers to be arranged along all side edges of the pane elements. In particular, at a lower side edge and/or the upper side edge of the pane elements, in use as intended, at least one connector placed between two spacers can be provided in each case.

A connector can have a length comparable to a spacer or can be substantially shorter. The dimension of an individual connector can be freely selected depending on the specific application.

The at least one spacer as well as the connector are used for spacing between the first pane element and at least one additional, second pane element.

The second pane element is likewise arranged along the at least one spacer and the at least one connector, preferably on an opposite side.

Alternatively, in the context of a triple glazing, a first, second, and third pane element can be provided along the spacer and the connector, with the second and third pane element arranged to the side of the spacer and the connector, respectively.

Moreover, the device according to the invention can also be provided as a multiple glazing with a corresponding number of pane elements.

The connector has at least the first electrically conductive conductor element such that an electrical connection between an external power source and the first pane element can be established via the first conductor element.

In particular, provision is made for being able to establish a connection to external current conductors or cable connections of an external power source via the connector or the at least one first conductor element of the connector.

"An electrically conductive conductor element" means any current-carrying element that can be accommodated by the connector, can be applied to a material of the connector, or can be integrated into a material of the connector.

In particular, in the context of the present invention, a conductor element can be designed as an electrically conductive cable, a strand, a wire, an electrically conductive coating, or the like.

For example, it is conceivable for a conductor element to be accommodated as a cable or integrally molded in the connector such that electrical energy can be transmitted to the first pane element.

The cable or the wire or the strand can be at least partially accommodated or molded in the connector.

Alternatively, provision can be made for the connector to comprise, at least partially, an electrically conductive material. In this context, the conductor element is provided as an integral conductor element in the connector. For example, electrical energy can be transmitted to the first pane element via the connector. Furthermore, the connector can be designed partially with an electrically conductive coating such that electrical energy can be coupled in from the outside and can be suitably transmitted all the way to the first pane element via the connector.

Provision can be made to provide such an electrically conductive coating on the conductor in a laser patterning process, an adhesive process, a sputtering process, 3D printing, a coextrusion process, a combined metal/plastic injection molding process, or in a comparable process.

In the context of the present invention, "an external power source" can mean in particular a current or voltage source, a battery, a solar cell, a Peltier element, or the like. Thus, "external power source" means any type of source of electrical current that is sufficient to supply a functional glazing or active glazing with sufficient voltage as required.

Furthermore, one connector can have a plurality of conductor elements such that different voltages or electrical potentials can be transmitted from associated external power sources to the first pane element by means of the one connector.

Moreover, a voltage can be introduced into the connector via one conductor element of the connector and forwarded to the first pane element via a plurality of conductor elements.

Thus, an advantageous reduction of external electrical connections can be achieved, while any desired distribution of the electrical potential or different electrical potentials is possible within the insulated glazing.

By means of the at least one connector, along one side edge of the first pane element, the selective and uniform transmission of electrical energy is advantageously available in order to be able to provide an active or functional glazing. A seal of the insulating glazing is penetrated exclusively in the region of the at least one connector such that the tightness of the system is ensured. Moreover, by using the dedicated current coupling along the at least one connector, the effort required for producing an active glazing or a functional glazing is reduced.

In general, in a window, the insulating glazing according to the invention is connected to a window frame, wherein the window frame can be provided in direct contact with or at a distance from the insulating glazing, to form an air gap.

Provision is made according to one embodiment for the first pane element to have at least one first conductor surface on a first pane side, wherein the first conductor element is electrically connected to the first conductor surface.

In particular, the first pane side is an activatable pane side of the first pane element or the first pane element is activatable via the first pane side.

In the intended state of use of the insulating glazing according to the invention or a corresponding window with a insulating glazing according to the invention, the first pane side is preferably an inwardly directed pane side.

The at least one first conductor surface is provided for the electrical coupling of the conductor element to the functional first pane element. Thus, optimum electrical transmission or transmission resistance between the conductor element and the first pane element is provided by means of the conductor surface, in particular with minimum electrical resistance.

The conductor surface can preferably have a silver paste or a silver paste print or a comparable element for the advantageous electrical coupling of the at least one first conductor element to the first pane element.

It is also conceivable for the conductor surfaces to be designed as copper conductor tracks or with a comparable material, with the conductor surfaces glued, or soldered on the first pane element, or arranged on the pane element by ultrasonic bonding, and coupled therewith.

Preferably, the at least one first conductor surface extends along the side edge of the pane element over at least a part of the first pane element or the first pane side such that an electrical potential from the conductor element of the connector can be uniformly transmitted via the conductor surface to the pane element.

In particular, compared to a point-wise introduction of an electrical potential, a suitable distribution of the electrical potential over a larger area of the first pane element is possible by means of the at least one first conductor surface.

Alternatively, it is conceivable for the electrically active or activatable first pane element to be able to be electrically contacted directly and immediately using the at least one conductor element. Thus, individual conductor surfaces and their application on the first pane element can be dispensed with.

According to another embodiment, the spacer and the connector form a receiving groove for accommodating the first pane element.

In particular, in the case of an insulating glazing according to the invention for a triple glazing, the spacer and the connector are designed such that a first, second, and third pane element can be accommodated and positioned relative to one another.

For this purpose, the spacer and the connector preferably have, in each case, a receiving groove, which, in the connected state, are aligned with one another along the common longitudinal axis. Thus, the first pane element can be accommodated within the receiving groove of the at least one spacer and of the at least one connector. In this case, the second pane element and the third pane element are arranged at the opposite outer sides of the spacer and the connector. The opposite outer sides of the spacer are the surfaces of the spacer provided for bonding with the second and third pane elements.

The second and third pane element are bonded to the spacer and the connector via a first sealing component such that a sealed interpane space is created. On the side of the spacer and the connector facing in the direction of a window frame in the finished window, a second sealing component is arranged, which serves to bond the panes and contributes to the stability of the insulating glazing. This corresponds to the side of the spacer facing away from the interpane space between the second and third pane elements.

Preferably, only the second sealing component is penetrated by a conductor element. The first sealing component is not penetrated by a conductor element. This improves the sealing of the insulating glazing.

In the case of a multiple glazing, the spacer and the connector are preferably provided with a corresponding plurality of receiving grooves.

Furthermore, provision can be made to insert a damping material for supporting the first pane element at least partially into the receiving groove in order to damp vibrations or the like. Such a damping material can, for example, be a thermoplastic elastomer.

The second pane element as well as the third pane element are, in this case, preferably provided along the opposite outer sides of the spacer and of the connector.

In the assembled state as intended for use, the second pane element can be regarded as an inner pane, whereas the third pane element can be an outer pane.

Alternatively, in the case of an insulating glazing with, for example, two pane elements, the first and second pane element are arranged on the opposite outer sides of the spacer or connector.

Thus, by means of one or a plurality of spacers as well as one or a plurality of connectors arranged therebetween, a suitable positioning of the pane elements for window with the insulating glazing according to the invention, in particular for a triple glazed window, can be done.

According to one embodiment, the first conductor surface extends along that part of the first pane element that is accommodated in the receiving groove of the spacer and/or of the connector.

Preferably, the at least one first conductor surface extends along the functional first pane element such that the conductor surface is concealed in the receiving groove of the spacer or connector. In particular, the at least one conductor surface can be provided in the immediate vicinity of the associated side edge of the first pane element.

Advantageously, the conductor surface or the electrical coupling of the first pane element is not visible from the outside. Thus, an aesthetic overall impression can be achieved by means of the insulating glazing according to the invention, in particular within a window.

According to another embodiment, a plurality of conductor surfaces are provided, spaced apart from one another along the first pane element, for connecting to a conductor element or different conductor elements.

A plurality of conductor surfaces, preferably spatially and electrically separated from one another, can be provided along a first pane surface. For example, two or more conductor surfaces that are connected to various conductor elements can be provided along the first pane surface. Thus, along the first pane element, different electrical potentials can be applied to the functional first pane element via the various conductor surfaces.

If a plurality of conductor surfaces are connected to the same conductor element or are subjected to the same electrical potential, uniform distribution of the electrical potential over the side length of the first pane element is alternatively possible.

The plurality of electrically separated conductor surfaces are arranged distributed along the side edge of the first pane element. The conductor surfaces preferably extend along the part of the first pane element that is accommodated in the receiving groove of the spacer or connector.

Preferably, a plurality of conductor surfaces can be arranged one behind another in the direction of the receiving groove. Alternatively, a plurality of conductor surfaces can be arranged one above another on the pane element or the first pane surface. Furthermore, it is conceivable for a plurality of conductor surfaces to be arranged or printed on one another and electrically separated from one another by means of interposed insulating layers. Thus, a stacked arrangement of the conductor surfaces can also be provided.

Moreover, a combination of the options for arranging a plurality of conductor surfaces along the first pane element can also be provided in the context of the present invention.

According to one embodiment, the connector has at least one recess, through which at least one of the conductor elements for connecting to one of the conductor surfaces of the first pane element is routed. The recess can have various shapes and can be implemented, for example, as a rounded, angular, elongated recess or an opening in a wall of the connector. The recess is introduced into the wall of the connector in a suitable manner and can, for example, be drilled, milled, or cut into the wall of the connector or can already be provided at the time of the manufacture of the connector.

In particular, the insulating glazing can be provided with one conductor element, two conductor elements, three conductor elements, four conductor elements, or any number of conductor elements. Furthermore, a corresponding number of conductor elements and conductor surfaces can be provided along the first pane element.

The recess preferably has an elongated shape and preferably extends substantially in the longitudinal direction of the connector. Preferably, it is implemented as an incision into the connector. This enables particularly simple production and particularly easy insertion of the conductor elements by simply pushing them into the recess from the side.

Provision is made for the connector to accommodate the at least one conductor element in the form of a cable or the electrically conductive wire or the cable strand in appropriately designed recesses. Thus, after production of the connector and during assembly of the insulating glazing, the conductor element can be inserted into the connector, positioned, and expediently connected to the first pane element and an external power source.

The at least one conductor element can be routed through the at least one recess of the connector before or after assembly of the connector with the at least one spacer. Thus, the conductor element can be arranged on or accommodated in the connector in a simple manner in order to establish an electrical connection between the external power source or external current cables and the first pane element.

Particularly preferably, the at least one conductor element is already routed through the at least one recess of the connector during production of the connector. This can be achieved particularly easily during an extrusion process or during an injection molding process. The tightness of such a component is particularly high.

Provision is made in another embodiment for the connector to have essentially a cross-sectional structure of the spacer.

Thus, the at least one connector and the at least one spacer preferably have the same cross-section in order to be connected to one another. In particular, in this manner, a common receiving groove for the first pane element of a triple glazing or a multiple glazing can be produced.

The connector and the spacer differ in their function in that the connector additionally serves to provide an electrical connection between an external power source and the first pane element.

In the context of the present invention, the connector can have slight deviations from the cross-sectional structure of the spacer. Thus, the connector can be designed with at least one recess for accommodating the conductor element in the form of, for example, a cable or a strand.

Consequently, the connector has a comparable or substantially identical cross-sectional structure compared to the at least one spacer. In particular, the outlines of a cross-section of the connector and of the spacer are preferably congruent.

According to another embodiment, at least one plug connector is provided for the non-positive and/or positive connection of the spacer to the connector.

In particular, the at least one spacer can be connected to the at least one connector by means of at least one plug connector.

Since spacers and connectors can be connected non-positively and/or positively by means of at least one plug connector in each case, a secure assembly of the pane elements of the insulating glazing can be provided.

In one embodiment, the basic structure of the spacer and the connector has in each case at least one hollow space for accommodating the plug connector.

In particular, the spacer and the connector can be implemented in each case as a hollow structure. Thus, the plug connector can be inserted into the hollow spaces of the spacer and the connector to provide a non-positive and/or positive connection.

The plug connector can be a conventional plug connector suitable for connecting commercially available spacers.

Alternatively, the at least one plug connector can form a fixed unit with a spacer.

In another embodiment, the at least one plug connector forms a fixed unit with a connector. Thus, less assembly effort is required for producing an insulating glazing according to the invention or a window according to the invention or a corresponding façade. Preferably, the basic structure of the spacer includes at least one hollow space and the connector includes at least one insertion leg that can be introduced into the hollow space of the spacer. Preferably, insertion legs that can be introduced into at least one hollow space of the spacer are arranged on both sides of the connector, in particular, fixedly connected to the connector in order to establish a non-positive and/or positive connection. Thus, less assembly effort and material outlay is required.

Multiple spacers with connectors positioned therebetween can advantageously be connected to form an insulating glazing according to the invention for a window frame or a window. According to one embodiment, the insulating glazing has a first sealing component and a second sealing component, wherein at least one conductor element exclusively extends through the second sealing component and not through the first sealing component in the region of the connector in order to provide a connection of the external power source to the first pane element. The first sealing component and the second sealing component are preferably implemented in one piece in each case.

The first sealing component is preferably provided for bonding the pane elements and for sealing the insulating glazing at the outer sides of the spacer and the connector. In this context, first sealing components are arranged in each case on the two outer sides of the spacer or connector.

The first sealing component can be a butyl sealing component or the like.

In particular, the at least one first sealing component can be provided unaffected by the electrical coupling of the first pane element and preferably in one piece as a continuous seal.

The second sealing component is preferably provided for sealing the insulating glazing relative to a window frame. In particular, the window frame can be spaced apart from the second sealing component, for example, to form an air gap. Thus, the second sealing component is provided along one side of the spacer or the connector that faces away from the space between the pane elements.

The second sealing component can be made of polyurethane, polysulfide, silicone, or the like.

Preferably, the first sealing component and the second sealing component are formed in one piece along one side edge of one pane element. Consequently, the first and second sealing components preferably extend over the spacers and connectors connected to one another along the entire length of the respective side edges of the pane elements.

In the region of the at least one connector, the second sealing component is penetrated or passed through at least once in order to be able to provide an electrical connection to an external power source by means of the connector or the conductor element.

In particular, provision is made for only the second sealing component and not the first sealing component to be penetrated in the region of the connector only by the at least one conductor element. Since only the second sealing component is passed through in the region of the connector by a conductor element, the connector ensures an electrical connection of a first pane element without penetration of the first seal being necessary. This substantially improves the tightness of the insulating glazing compared to prior art glazings in which the electrical connection is made with penetration of the first and second seals.

Preferably, provision can be made for the conductor element to be cast in the second sealing component or molded with the second sealing component.

Thus, the tightness of the insulating glazing, in particular of the interpane spaces between the pane elements is ensured. In addition, the effort required for producing and electrically connecting the insulating glazing is reduced.

A coordinate aspect of the invention provides a window, in particular an insulating glazed window or a triple glazed window with an insulating glazing according to the invention.

Using at least one connector, preferably placed between two spacers, an electrical connection to the functional first pane element can be provided, wherein optimized gas- and liquid-tightness of the window as well as reduced labor and cost outlays for producing the window according to the invention are likewise achieved.

The invention is explained in the following with reference to the accompanying figures.

Figure 2A:
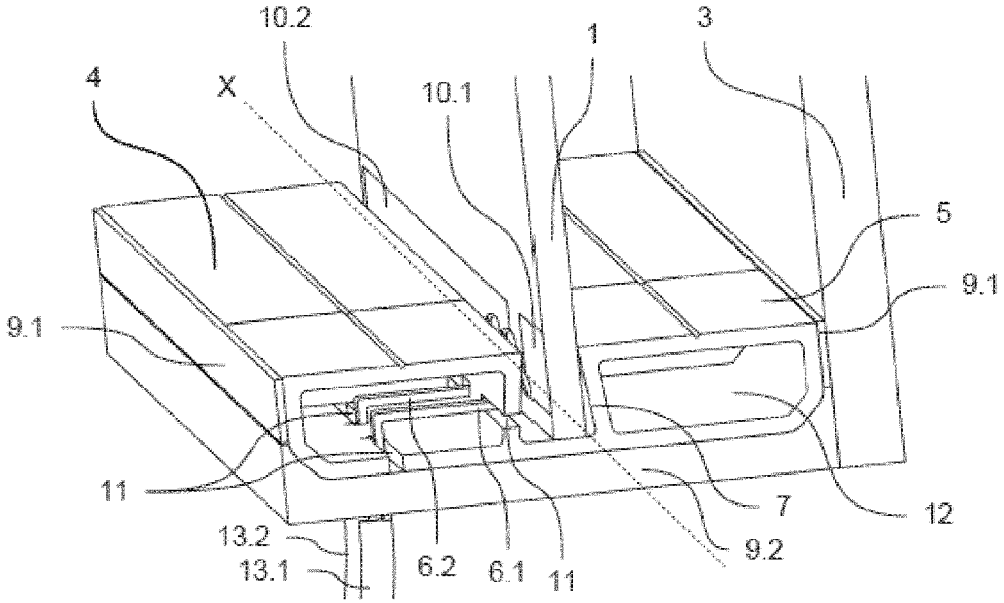
Figure 3:
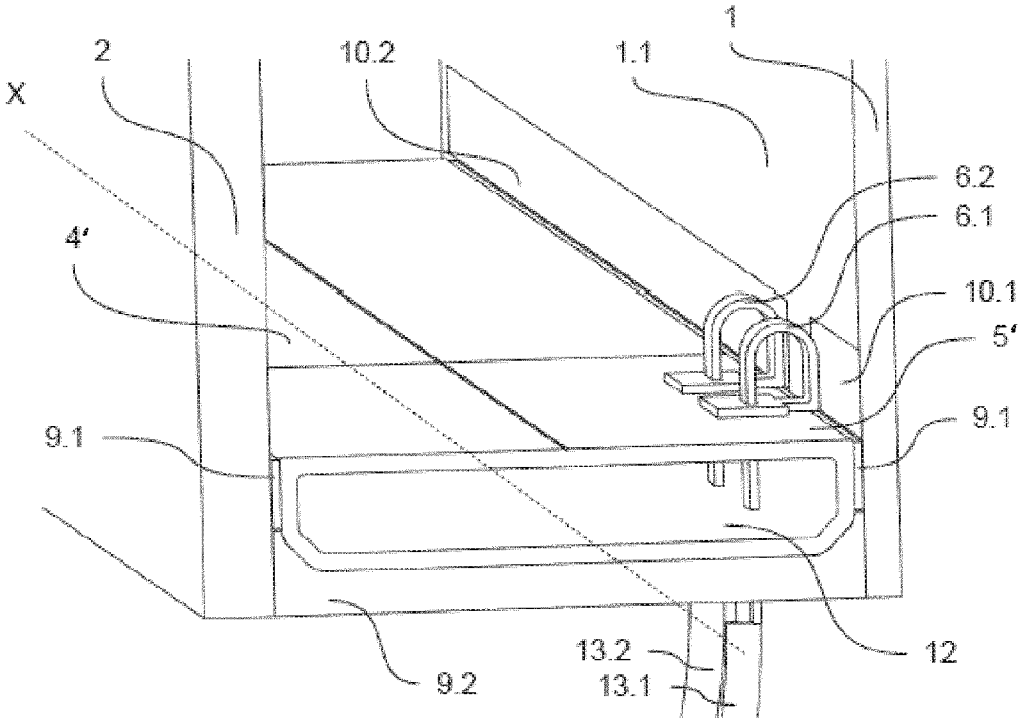
Figure 4:
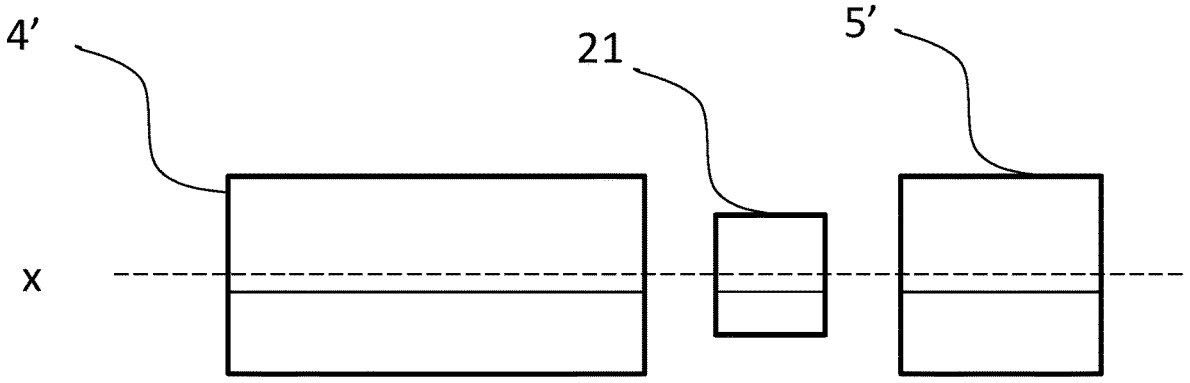

Schematically, they depict:

FIG. 1 an overview of a first exemplary embodiment of the invention with triple glazing;

FIG. 2*a, b* an isometric front view of the first exemplary embodiment of FIG. 1;

FIG. 3 an isometric front view of a second exemplary embodiment of the invention with double glazing, and FIG. 4 schematically shows an exploded side view of the spacer, the plug connector and the connector.

FIG. 1 depicts an overview of a first exemplary embodiment of an insulating glazing, in particular a triple glazing. In particular, the insulating glazing is depicted in a sectional view.

The insulating glazing is shown with a first, second, and third pane element 1; 2; 3. In addition, the insulating glazing has a connector 5. A spacer 4 connected to the connector 5 is not visible in FIG. 1 or is concealed by the second pane element 2.

In this context, the insulating glazing of FIG. 1 is implemented as a triple insulating glazing. The connector 5 or the spacer 4 are expediently implemented for accommodating the three pane elements of the triple insulating glazing.

Preferably, the second pane element 2 is an inner pane, whereas the third pane element 3 is an outer pane. The centrally arranged first pane element 1 is implemented as an active or functional pane element.

Preferably, the insulating glazing of FIG. 1 can be an electrochromatic glazing or a liquid crystal glazing, wherein, in particular, the first pane element 1 is the functional pane element.

The second and third pane element 2; 3 are arranged on the outer sides of a spacer 4 or a connector 5. The first pane element 1 is accommodated and positioned in a receiving groove 7 of the spacer 4 or connector 5.

A second sealing component 9.2 that extends along the width of the connector 5 is shown between the connector 5 and the second and third pane element 2, 3. In particular, the second sealing component 9.2 extends along the width of the connector 5 on its side facing away from the first pane element 1.

The second sealing component 9.2 is intended in particular to increase the mechanical stability of the insulating glazing and the sealing of the insulating glazing. The second sealing component 9.2 is preferably implemented in one piece.

In addition, FIG. 1 shows two external current conductors or external cables 13.1; 13.2 that extend in the direction of the connector 5. In particular, the external current conductors 13.1; 13.2 are provided to connect the insulating glazing to an external power source for transmitting electrical energy.

In the context of the use of the insulating glazing depicted in FIG. 1, it is intended for the insulating glazing to be expediently surrounded by a window frame. Thus, the window frame can be connected to the second sealing component 9.2 or preferably provided at a distance from the second sealing component 9.2.

FIG. 2*a* is an enlarged view of the first exemplary embodiment of the insulating glazing of FIG. 1.

The connector 5 is shown connected to a spacer 4. The connection is preferably done by means of plug-in connectors (not shown in FIG. 2*a*, 2*b*), which are inserted into hollow spaces 12 of the spacer 4 and the connector 5.

In the context of FIG. 2*a*, the device can have one or a plurality of connectors 5 along a side edge of the first pane element 1, which are in each case individually placed between spacers 4.

According to FIG. 2*a*, the third pane element 3 or the second pane element 2 (not shown in FIG. 2*a*) is provided on side surfaces of the connector 5 or of the spacer 4. The second and third pane element 2; 3 respectively are bonded with a first sealing component 9.1 along the side surfaces of the connector 5 and the spacer 4.

The first sealing component 9.1 can be a butyl bond or a butyl seal.

The second sealing component 9.2 is provided between the second and third pane element 2; 3 across the width of the connector 5 or the spacer 4. The second sealing component is intended in particular to increase the mechanical stability of the insulating glazing and the sealing of the insulating glazing.

The first pane element 1 is arranged in a receiving groove 7, which is formed by the spacer 4 and the connector 5 along a common longitudinal axis X. The receiving groove 7 is substantially U-shaped or similarly shaped.

Preferably, a damping material (not shown in FIG. 2*a*), which can serve for bonding the first pane element 1 as well as for damping of movements of the first pane element 1, can be provided within the receiving groove 7.

In addition, the first pane element 1 has, on a first functional pane side 1.1 according to FIG. 2*a*, a first and a second conductor surface 10.1; 10.2. The first and second conductor surface 10.1; 10.2 are substantially rectangular and are arranged spatially and electrically separated from one another on the first pane element 1.

The first pane element 1 can be designed with an electrically activatable or active coating on a first pane side 1.1 (not shown in FIGS. 1 to 3). Thus, the first pane element 1 can be provided as a functional or activatable pane element.

The conductor surfaces 10.1; 10.2 are provided in close proximity to the side edge of the first pane element 1. In particular, the conductor surfaces 10.1; 10.2 are arranged along that part of the first pane element 1 that is situated in the receiving groove 7 of the connector 5 or the spacer 4.

Thus, an aesthetic external overall impression can be achieved, making it possible to dispense with a black print coating as a screen, e.g., along the second and/or third pane element 2; 3 or or along the pane side of the first pane element 1 opposite the first pane side 1.1.

Preferably, the first and second conductor surface 10.1; 10.2 are arranged as close as possible to the side edge of the first pane element 1.

If need be, according to FIG. 2*a*, the first and second conductor surface 10.1; 10.2 can be spaced at a distance from the side edge of the first pane element 1. This is, in particular, advantageous in the case of combinations with a connector made of a conductive material such as metal.

According to FIG. 2*a*, the connector 5 is provided with two conductor elements 6.1; 6.2. The conductor elements 6.1; 6.2 extend through elongated recesses 11 of the connector 5 from the second sealing component 9.2 all the way to the conductor surfaces 10.1; 10.2 of the first pane element 1.

The recesses 11 of the connector are implemented as incisions in the direction of the longitudinal axis X and are used for the passage of the conductor elements 6.1; 6.2. The conductor elements 6.1; 6.2 are, according to FIG. 2*a*, implemented in particular as electrically conductive cables or strands. Alternatively, the conductor elements 6.1; 6.2 can be implemented as conductor tracks.

Within the receiving groove 7, the conductor elements 6.1; 6.2 extend in a V-shaped pattern in the direction of the respective conductor surface 10.1; 10.2. Thus, the first and second conductor surface 10.1; 10.2 can be connected to various conductor elements 6.1; 6.2 and, if need be, can be subjected to different electrical potentials.

Thus, different functions of the functional pane or of the functional first pane element 1 can be carried out along the two conductor elements 6.1; 6.2 depending on the electrical voltage applied.

The conductor elements 6.1; 6.2 are accommodated in the connector 5 and extend through the recesses 11 in the direction of the second sealing component 9.2. Alternatively, provision can preferably be made to integrally incorporate conductor elements 6.1; 6.2 in the connector 5 or to to cast them in the material of the connector 5. This embodiment has, in particular, improved tightness and is easy to produce.

In particular, the conductor elements 6.1; 6.2 pass exclusively through the second sealing component 9.2 and have in each case a connection to one of the external current cables 13.1; 13.2. Thus, an electrical connection to the conductor surfaces 10.1; 10.2 can be established by means of the connector 5 with the conductor elements 6.1; 6.2.

Preferably, the conductor elements 6.1; 6.2 are cast in the second sealing component 9.2 in order to ensure tightness of the device.

Thus, an electrical connection can be established from the external current cables or current conductors 13.1; 13.2 according to FIG. 2*a* to the connected external power source via the connector 5 to the conductor surfaces 6.1; 6.2 of the first pane element 1.

Figure 2B:
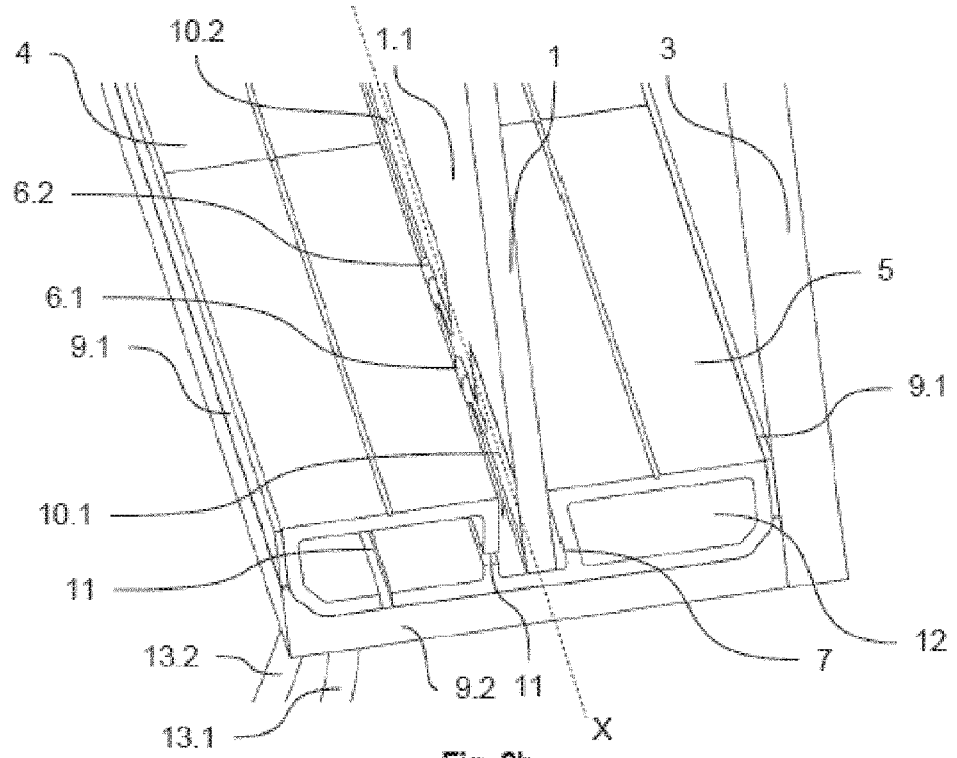

FIG. 2*b* again depicts the first exemplary embodiment according to FIG. 2*a* from a rotated perspective.

In particular, it is clear that the first and second conductor element 6.1; 6.2 are in each case connected to one of the conductor surfaces 10.1; 10.2 electrically separated from one another. The conductor surfaces 10.1; 10.2 as well as the conductor elements 6.1; 6.2 are arranged distributed along the receiving groove 7 and along the first pane element 1.

Since the electrical connection between an external power source or external power cables 13.1; 13.2 and the first pane element 1 is made exclusively via the conductor elements 6.1; 6.2 of the connector 5, simplified production of the insulating glazing is ensured.

Furthermore, the conductor elements 6.1; 6.2 of the connector 5 only have to be passed through the second sealing component 9.2 over a short distance.

In particular, when the conductor elements 6.1; 6.2, designed as cables or strands according to the first exemplary embodiment, are cast in the second sealing component 9.2 as cables or strands, complete tightness of the insulating glazing can advantageously be achieved with the first and second sealing component 9.1; 9.2.

According to FIG. 1 through 2*b*, the receiving groove 7 is arranged substantially centrally or symmetrically to the connector 5 or spacers 4.

Alternatively, the receiving groove 7 can be shifted to one side or implemented asymmetrically. In particular, the connector 5 can be implemented with an asymmetrically arranged receiving groove 7.

Thus, for example, less distance can be provided between the first and second pane element 1; 2, than between the first and third pane element 1;3. Thus, it is, for example, possible to achieve optimization of the acoustics or the sound damping values.

FIG. 3 depicts a second exemplary embodiment of the insulating glazing as a double glazing.

Essentially, the second exemplary embodiment according to FIG. 3 differs from the first exemplary embodiment according to FIG. 1 in its design as a double glazing and the associated design of the cross-sectional structure of the at least one spacer 4' and the at least one connector 5'.

The connector 5' is connected to a spacer 4'. Preferably, the connector 5' is placed between two spacers 4'. In FIG. 3, the insulating glazing is depicted in a cross-section through a connector 5'.

The connector 5' can, expediently, have the same length as a spacer 4', or be implemented substantially shorter.

The connector 5' and the spacer 4' are in each case designed with a hollow space 12.

In particular, the connector 5' and the spacer 4' have an identical cross-sectional structure. The connector 5' and the spacer 4' are connectable by means of a plug connector (not shown in FIG. 3) that can be introduced into the hollow spaces.

FIG. 4 schematically shows an exploded side view of the spacer 4', the plug connector 21 and the connector 5'. The plug connector 21 can be inserted into the hollow spaces of the spacer 4' and the connector 5' to provide a non-positive and/or positive connection.

The first pane element 1 is bonded to a side surface of the connector 5' by means of the first sealing component 9.1. The second pane element 2 is attached or bonded to the opposite outer side of the connector 5' by means of the first sealing component 9.1.

In the exemplary embodiment according to FIG. 3, the first pane element 1 can be provided as an outer pane. The functional first pane surface 1.1 of the first pane element 1 faces the second pane element 2 of the insulating glazing. The second pane element 2 is, in this exemplary embodiment, preferably an inner pane of the insulating glazing.

The second sealing component 9.2 is provided between the first and second pane element 1; 2 along the width of the connector 5' or the spacer 4' such that the connector 5' or the spacer 4' is sealed relative to a window frame.

The first and second sealing component 9.1; 9.2 are preferably designed in one piece in each case.

In particular, the insulating glazing of FIG. 3 is provided such that a window frame structure for a window can be provided on the second sealing component 9.2.

According to FIG. 3, two conductor surfaces 10.1; 10.2 spaced at a distance from one another are provided along the first pane side 1.1 of the first pane element 1. The conductor surfaces 10.1; 10.2 are electrically separated from one another.

The conductor surfaces 10.1; 10.2 can preferably be implemented as a silver paste print or the like such that an expedient coupling of an electrical potential to the first pane element 1 is possible.

In particular, provision is made that the first and second conductor surface 10.1; 10.2 are arranged separated from one another such that different electrical potentials can be coupled in via the first and second the conductor surface 10.1; 10.2.

Furthermore, the first and second conductor surface 10.1; 10.2 are arranged above the first sealing component on the first pane element 1. In order to achieve an aesthetic overall impression, a black print can be provided, for example, along the first pane element 1 such that the conductor surfaces 10.1; 10.2 are not visible in the intended state of use of the insulating glazing.

A conductor element 6.1; 6.2 is coupled in each case to the first and second conductor surface 10.1; 10.2. The conductor elements 6.1; 6.2 are provided according to FIG. 3 as wire-shaped conductor elements or the like. In particular, the first and second conductor element 6.1; 6.2 have in each case an arcuate part for coupling to the respective first and second conductor surface 10.1; 10.2.

The conductor elements 6.1; 6.2 are accommodated in or on the connector 5' such that an electrical connection can be established between the first pane element 1 and an external power source via the connector 5'.

The conductor elements 6.1; 6.2 pass through the connector 5' with the hollow space 12 and through the second sealing component 9.2. Only the first and second conductor element 6.1; 6.2 penetrate the second sealing component 9.2 by the shortest possible route.

Preferably, the first and second conductor element 6.1; 6.2 are cast in the second sealing component 9.2.

According to FIG. 3, the conductor elements 6.1; 6.2 open in each case into an external current conductor 13.1; 13.2 of an external power source. Thus, by means of the conductor elements 6.1; 6.2 of the connector 5', an electrical connection to the first pane element 1 can be established.

In general, by means of the insulating glazing according to the invention or a window according to the invention through the use of at least one special connector 5; 5', it is advantageously possible to establish an electrical connection between an external power source and the first pane element 1.

Using the at least one connector 5, the at least one conductor element 6.1; 6.2, and the at least one conductor surface 10.1; 10.2, uniform introduction of an electrical potential on the first pane element 1 can be done.

At the same time, improved sealing is ensured along with lower production effort and reduced production costs.

LIST OF REFERENCE CHARACTERS

1 first pane element
1.1 first pane side of the first pane element
2 second pane element
3 third pane element
4; 4' spacer
5; 5' connector
6.1 conductor element
6.2 conductor element
7 receiving groove
9.1 first sealing component
9.2 second sealing component
10.1 first conductor surface
10.2 second conductor surface
11 recess
12 hollow space
13.1 external current conductor
13.2 external current conductor
X longitudinal axis

The invention claimed is:

1. An insulating glazing comprising at least one first pane element, a second pane element and a third pane element, at least one spacer, at least one connector, and at least one first sealing component and at least one second sealing component, wherein the at least one spacer and the at least one connector are arranged next to each other such that the at least one spacer and at least one connector extend along a common longitudinal axis, wherein the at least one spacer and the at least one connector form a receiving groove for accommodating the at least one first pane element, the at least one spacer and the at least one connector accommodate and position the at least one first pane element within the receiving groove, and wherein the at least one connector has at least one electrically conductive conductor element such that an electrical connection is established between an external power source and the at least one first pane element via the at least one electrically conductive conductor element, wherein the at least one electrically conductive conductor element extends exclusively through the at least one second sealing component in a region of the at least one connector to establish a connection of the external power source to the at least one first pane element, wherein along the at least one first pane element a plurality of conductor surfaces are provided spaced apart from one another for connecting to the at least one electrically conductive conductor element, wherein the plurality of conductor surfaces are concealed in the receiving groove of the at least one spacer and/or at least one connector, and wherein the at least one connector has at least one recess, through which the at least one electrically conductive conductor element is passed for connecting to at least one of the plurality of conductor surfaces of the at least one first pane element, the at least one recess being opposite to the at least one conductor surface.

2. The insulating glazing according to claim 1, wherein the at least one connector has a cross-sectional structure of the at least one spacer.

3. The insulating glazing according to claim 1, wherein at least one plug connector is provided for a non-positive and/or positive connection of the at least one spacer to the at least one connector.

4. The insulating glazing according to claim 3, wherein a basic structure of the at least one spacer and of the at least one connector has in each case at least one hollow space for accommodating the at least one plug connector.

5. The insulating glazing according to claim 3, wherein the at least one connector includes at least one insertion leg and a basic structure of the at least one spacer includes at least one hollow space suitable for accommodating the at least one insertion leg for producing a non-positive and/or positive connection.

6. The insulating glazing according to claim 1, wherein the at least one first sealing component and the at least one second sealing component are in each case formed in one piece.

7. A window with insulating glazing according to claim 1.

8. The insulating glazing according to claim 1, wherein the insulating glazing is a triple glazing or a multiple glazing.

* * * * *